US008965233B2

(12) United States Patent
Katahira

(10) Patent No.: US 8,965,233 B2
(45) Date of Patent: Feb. 24, 2015

(54) PRINTING AN IMAGE WITH CONSUMABLE PRODUCT PROCUREMENT AND WARNING INFORMATION

(71) Applicant: Canon Kabushiki Kaisha, Tokyo (JP)

(72) Inventor: Yoshiaki Katahira, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 20 days.

(21) Appl. No.: 13/751,818

(22) Filed: Jan. 28, 2013

(65) Prior Publication Data

US 2013/0216253 A1 Aug. 22, 2013

(30) Foreign Application Priority Data

Feb. 20, 2012 (JP) ..... 2012-034239

(51) Int. Cl.
*G03G 15/00* (2006.01)

(52) U.S. Cl.
CPC ..... *G03G 15/553* (2013.01); *G03G 15/502* (2013.01)
USPC ..... 399/81; 399/79

(58) Field of Classification Search
USPC ..... 399/79, 81
See application file for complete search history.

(56) References Cited

U.S. PATENT DOCUMENTS

| | | | | |
|---|---|---|---|---|
| 7,663,770 | B2 * | 2/2010 | Campbell et al. | 358/1.15 |
| 7,873,756 | B2 | 1/2011 | Shoji | |
| 2003/0142338 | A1 * | 7/2003 | Campbell et al. | 358/1.14 |
| 2005/0137941 | A1 | 6/2005 | Fujinawa | |

FOREIGN PATENT DOCUMENTS

| | | |
|---|---|---|
| JP | 2005-181841 | 7/2005 |

* cited by examiner

*Primary Examiner* — G. M. Hyder
(74) *Attorney, Agent, or Firm* — Fitzpatrick, Cella, Harper & Scinto

(57) ABSTRACT

The image forming apparatus determines whether or not supplementation of a consumable product is required, and whether or not an image corresponding to the consumable product procurement information including information related to the procurement of the consumable product is recorded by linkage with the consumable product. Then when the image forming apparatus determines that that supplementation of a consumable product is required, and that an image corresponding to the consumable product procurement information is recorded by linkage with the consumable product, a printing instruction screen for the image is displayed, and the printing of the image is performed in accordance with the printing instructions input through the printing instruction screen.

7 Claims, 9 Drawing Sheets

PRINTING AN IMAGE WITH CONSUMABLE PRODUCT PROCUREMENT AND WARNING INFORMATION

BACKGROUND OF THE INVENTION

1. Field of the Invention

The present invention relates to an image forming apparatus, a control method for the image forming apparatus, and a storage medium.

2. Description of the Related Art

Operation of a printer or a multifunctional device requires consumable products that are consumed by printing or scanning of an image such as toner, a photosensitive drum unit, recording paper, and an ADF roller unit, and the like. A known method of procuring consumable products includes a technique that enables procurement of consumable products by a user by use of a network when there is an insufficient residual amount of a consumable product in a printer. Furthermore, a technique is known of autodialing to a predetermined procurement source when there is an insufficient residual amount of a consumable product.

However, the above techniques require the provision of a unit that communicates with an external unit such as a public telephone line, network and the like in a printer or multifunctional device. Furthermore, when automatic ordering is performed, the consumable product is procured contrary to the intention of the user. A technique disclosed in Japanese Patent Application Laid-Open No. 2005-181841 is an example of a known method for solving the above case. The image forming apparatus disclosed in Japanese Patent Application Laid-Open No. 2005-181841 functions as a printer, stores consumable product sales information in the form of a written entry by a sales party or manufacturer, and outputs and prints the stored consumable product sales information.

However the technique disclosed in The apparatus disclosed in Japanese Patent Application Laid-Open No. 2005-181841 requires provision of dedicated application software in a personal computer and the like of a sales party of the image forming apparatus or in the personal computer of a manufacturer of the image forming apparatus in order to record the consumable product sales information. Furthermore, time and effort are required to use the personal computer of the sales party or manufacturer so as to connect with the image forming apparatus through a network and create a written entry and record of the consumable product sales information. In addition, during the use of the personal computer of the sales party or manufacturer to create a written entry and record of the consumable product sales information, an entry error may occur in relation to the consumable product sales information. Therefore, the user who orders the consumable product with reference to the consumable product sales information that is outputted for printing may perform an erroneous order.

The automatic printing out of consumable product sales information in response to the consumable product state results in unnecessary use of toner and paper if the consumable product sales information is not deemed desirable by the user themselves. Furthermore, although the image forming apparatus prints information related to the sales party, the outputted consumable product information may be communicated to the sales party with respect to an enquiry that should actually be directed to the manufacturer support center and the like. For example, it could be assumed that when an order is made due to an outage of toner in the image forming apparatus, the user refers to the outputted consumable product information and contacts the sales party that is the order destination for toner. In a situation other than an order for toner by a user, it may be the case that an enquiry with respect to a malfunction (for example, startup failure) of the image forming apparatus that actually should be directed to the manufacturer support center is made to the sales party. This also results in unnecessary communication costs to the user and there is a considerable burden on the sales party.

SUMMARY OF THE INVENTION

The image forming apparatus according to the present invention ensures accurate ordering and communication in accordance with an intention of a user when supplementation of a consumable product is required, and that reduces the burden on a user/or party receiving an order for a consumable product.

An image forming apparatus according to according to a first an aspect of the present invention includes a detection unit configured to detect that supplementation of a consumable product is required, a determination unit configured to determine whether or not an image corresponding to consumable product procurement information including information related to procurement of the consumable product is recorded by linkage with the consumable product, a display unit configured to display a printing instruction screen of the image when the detection unit detects that supplementation of the consumable product is required and the determination unit determines that an image corresponding to the consumable product procurement information is recorded by linkage with the consumable product, and a printing unit configured to print the image in response to the printing instruction through the printing instruction screen.

Further features of the present invention will become apparent from the following description of exemplary embodiments with reference to the attached drawings.

BRIEF DESCRIPTION OF THE EMBODIMENTS

Figure 1:
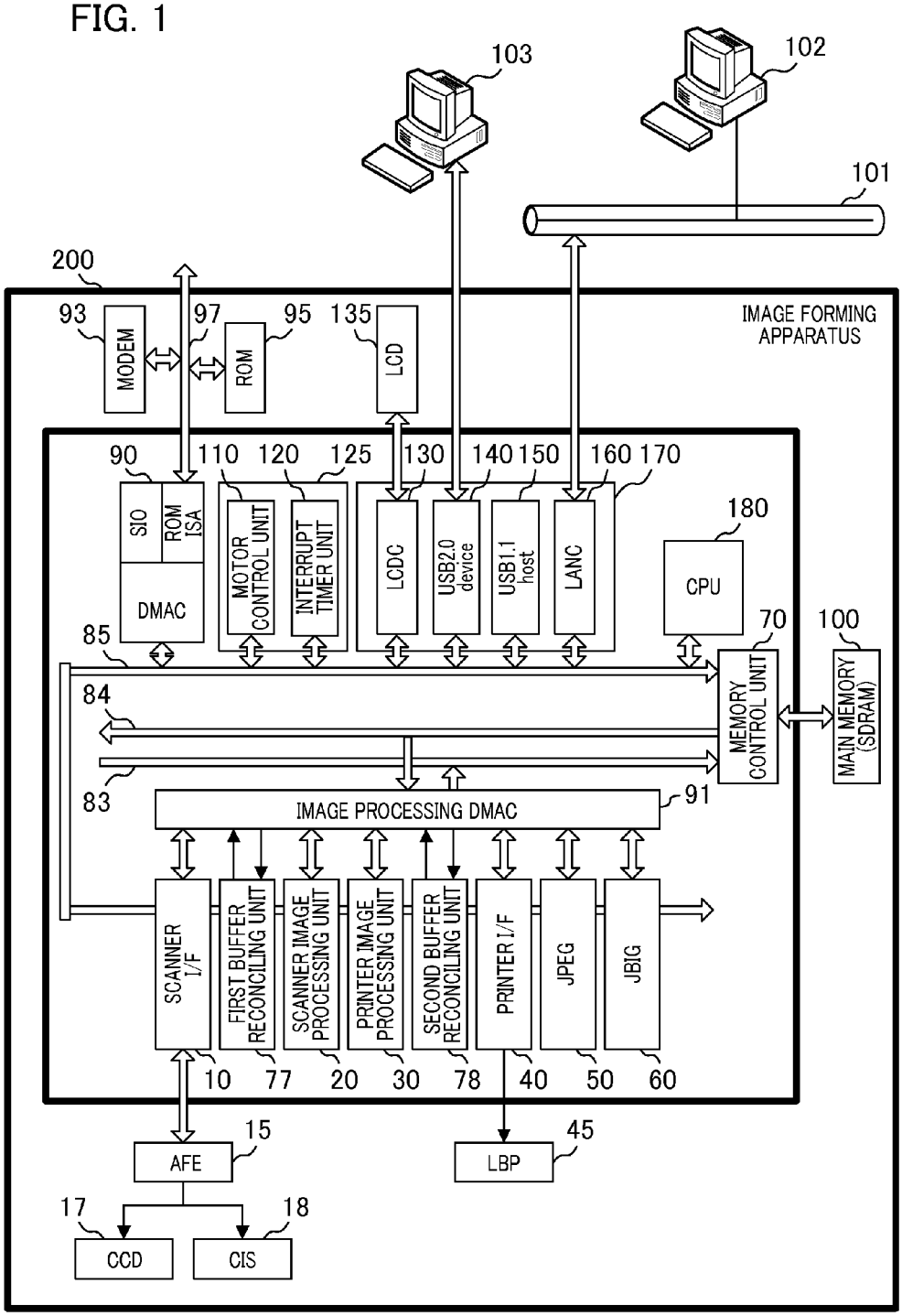
FIG. 1 illustrates an exemplary hardware configuration according to the present embodiment.

FIG. 1 illustrates a hardware configuration example of an image forming apparatus 200 according to the first embodiment of the present invention. The image forming apparatus 200 includes a scanner interface (hereinafter referred to as "scanner I/F") unit 10, a scanner image processing unit 20, a printer image processing unit 30, a printer I/F 40, a JPEG 50, and a JBIG 60. The image forming apparatus 200 includes an analog front end (AFE) 15 as a scanner unit, a CCD 17, and a CIS 18. Furthermore, the image forming apparatus 200 includes an LBP 45, a first and second buffer reconciling unit 77, 78, a memory control unit 70, a main memory (SDRAM) 100, and a central processing unit (CPU) 180.

A scanner unit that is the image input device is connected to the scanner I/F unit 10. The scanner I/F unit 10 enables uptake of image data read from the CCD 17 or CIS 18 through the AFE 15 in the scanner unit into the scanner I/F unit 10. The scanner I/F unit 10 enables uptake of the output of the document detection sensor from the automatic document feed apparatus (ADF) (not illustrated) that is provided in the scanner unit into the scanner I/F unit 10. The data processing executed by the scanner I/F unit 10 will be described in detail below.

The scanner image processing unit 20 executes image processing in response to the image processing operation mode to image data that is developed in the main memory 100 depending on processing by the scanner I/F unit 10. For example, an image processing operation mode includes color copying, monochrome copying, color scanning, monochrome scanning and the like. The first buffer reconciling unit 77 reconciles writing and reading of data when transfer of data occurs between the scanner I/F unit 10 and the scanner image processing unit through a ring buffer region of the main memory 100.

The printer image processing unit 30 is processing unit for editing of the region for image input and resolution conversion, and outputting acquired image data to the printer. The printer I/F 40 is a LBP interface (I/F) for output of the image processing result to the laser beam printer (LBP) and can be connected to the LBP 45. The second buffer reconciling unit 78 reconciles writing and reading of data when transfer of data occurs between the printer image processing unit 30 and the LBP interface 40 through a ring buffer region of the main memory 100. The JPEG 50 and the JBIG 60 are processing units for execution of compression and decompression of image data with reference to a predetermined standard.

The image forming apparatus 200 includes a first BUS 83, a second BUS 84, a third BUS 85, a DMA 90, an image processing DMAC 91, a MODEM 93 a read only memory (ROM) 95 and a ROMISA 97. The image forming apparatus 200 includes a mechatronic control unit 125 and a user interface control unit 170. The memory control unit 70 is connected respectively to the first BUS 83 and the second BUS 84 of the image processing system and to the third BUS 85 of the computer system, and performs data transfer control for writing and reading of data to the main memory (SDRAM) 100. The image processing DMA controller (DMAC) 91 is operably connected with the memory control unit 70 to generate and set predetermined address information for DMA control in relation to data transfer between the respective image processing units (10, 20, 30, 40) and the main memory 100. The DMAC 90 is connected to the ROM 95 through the ROMISA 97 for setting of suitable control parameters and control programs in response to the image reading device (CCD 17 or CIS 18). The MODEM 93 is a modem that converts digital data and audio data.

The first BUS 83 is a bus that enables sending of data read from the main memory 100 to the respective processing units (10 to 60) of the image processing system. The second BUS 84 enables sending of data read from the respective processing units (10 to 60) of the image processing system to the main memory 100. The first BUS and the second BUS are configured as a pair and perform image data transfer between the image processing block and the main memory 100. The third BUS 85 is a bus for the computer system and is connected to the DMAC 90, the control register of the inner portion of the image forming apparatus 200, the mechatronic control unit 125, the communication and user interface control unit 170 and the CPU 180.

The mechatronic control unit 125 includes a motor control unit 110 and an interrupt timer control unit 120 control timing for synchronized control of processing by the image processing system or drive timing for the motor.

The communication and user interface control unit 170 includes an LCD control unit (LCDC) 130, a USB 2.0 device 140, a USB 1.1 host 150 and an LANC 160. The LCDC 130 is a processing unit for control of the display on the LCD 135 of the processing state and various types of settings for the image forming apparatus. The LCDC 130 plays the role of communicating information input on the LCD 135 by a user that uses the image forming apparatus 200 through the third BUS 85 to the CPU 180.

The USB 2.0 device 140 and the USB 1.1 host 150 are USB interface units enabling connection with peripheral devices. FIG. 1 illustrates the connection state of the Host PC 103 through the USB 2.0 device 140. The LANC 160 is a network I/F unit for communicating with one or a plurality of network devices, and is connected with the Host PC 102 through a cable network 101. The overall operation of the image forming apparatus 200 is controlled by the CPU 180.

Configuration of Scanner I/F UNIT 10

The configuration of the scanner I/F UNIT 10 will be described below. The scanner I/F UNIT 10 is adaptable to CCD and CIS as an image reading device, and processes input signals from both image reading devices. The image data input into the scanner I/F UNIT 10 is transferred to the DMA by the memory control unit 70 and developed on the main memory 100.

Figure 2:
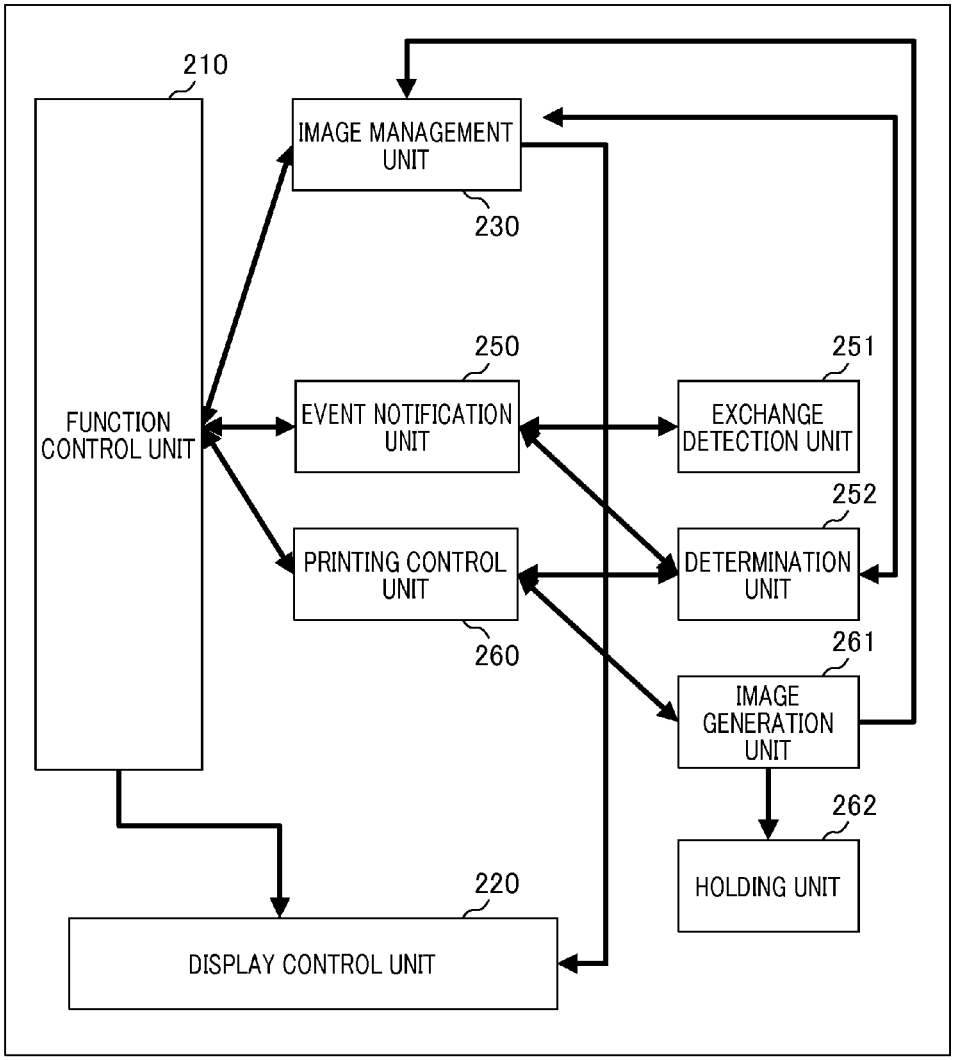
FIG. 2 illustrates an exemplary software configuration in relation to the consumable product procurement information function.

FIG. 2 illustrates a software configuration example of the image forming apparatus 200 in relation to a notification function of consumable product procurement information. The processing unit related to this function is configured by a function control unit 210, a display control unit 220, an image management unit 230, an event notification unit 250, an exchange detection unit 251, a determination unit 252, a printing control unit 260, an image generation unit 261, and a holding unit 262.

The CPU 180 performs respective processing in accordance with a control program stored in the ROM 95. The function control unit 210 controls the display control unit 220, the image management unit 230, and the event notification unit 250 and the printing control unit 260. The function control unit 210 receives print data from the USB or image data scanned by the scanner according to the control of the CPU 180. The display control unit 220 displays the message or the state of the image forming apparatus 200 that is described making reference to FIG. 4A to FIG. 4H and FIG. 5A to FIG. 5C on the LCD 135. The value input by the user from the operation unit 150 is acquired by the display control unit 220 as described making reference to FIG. 3.

When the sales party initially places the image forming apparatus, the image management unit 230 receives and records image data from the function control unit 210 via input of print data from the USB that functions as an external storage apparatus, or by use of a scanner. That is to say, the image management unit 230 functions as a recording unit that records an image during initial setting of the image formation. More specifically, the image management unit 230 stores image data in the ROM 95. Furthermore, the image management unit 230 receives an event notification setting from the function control unit 210 that acquires event notification settings that are input from the operation unit 150, and stores the event notification setting in association with the image data. An event notification setting means a notification setting that is recorded for notifying a user as event of a requirement for toner supplementation, toner exchange, recording paper supplementation as illustrated in the event notification record 410 in FIG. 4A or the like. The image management unit 230 stores and links the respective record images to the respective consumable products contained in the notification settings. In this manner, the image generation unit 261 can acquire product information corresponding to a recorded image from the holding unit 262. The image management unit 230 deletes the stored image data or event notification settings. The UI flow will be described below making reference to FIG. 4A to FIG. 4H and the processing will be described below making reference to FIG. 7.

The scan image that is managed by the image management unit 230 will be described next. The CPU 180 transfers image data such as a business card and the like scanned by use of the scanner (CCS 17, CIS 18) to the function control unit 210. More specifically, the CPU 180 develops the image data by use of the scanner I/F unit 10 to the main memory 100. Then, an instruction is received from the function control unit 210, and the image management unit 230 expands the valid image region for scanned image data to the maximum size that is contained without omission in the consumable product procurement information report 600 illustrated in FIG. 6. The image management unit 230 stores the image data after expansion processing. That is to say, the image management unit 230 functions as an image processing unit for execution of image processing to expand the image size when printing.

Figure 6:
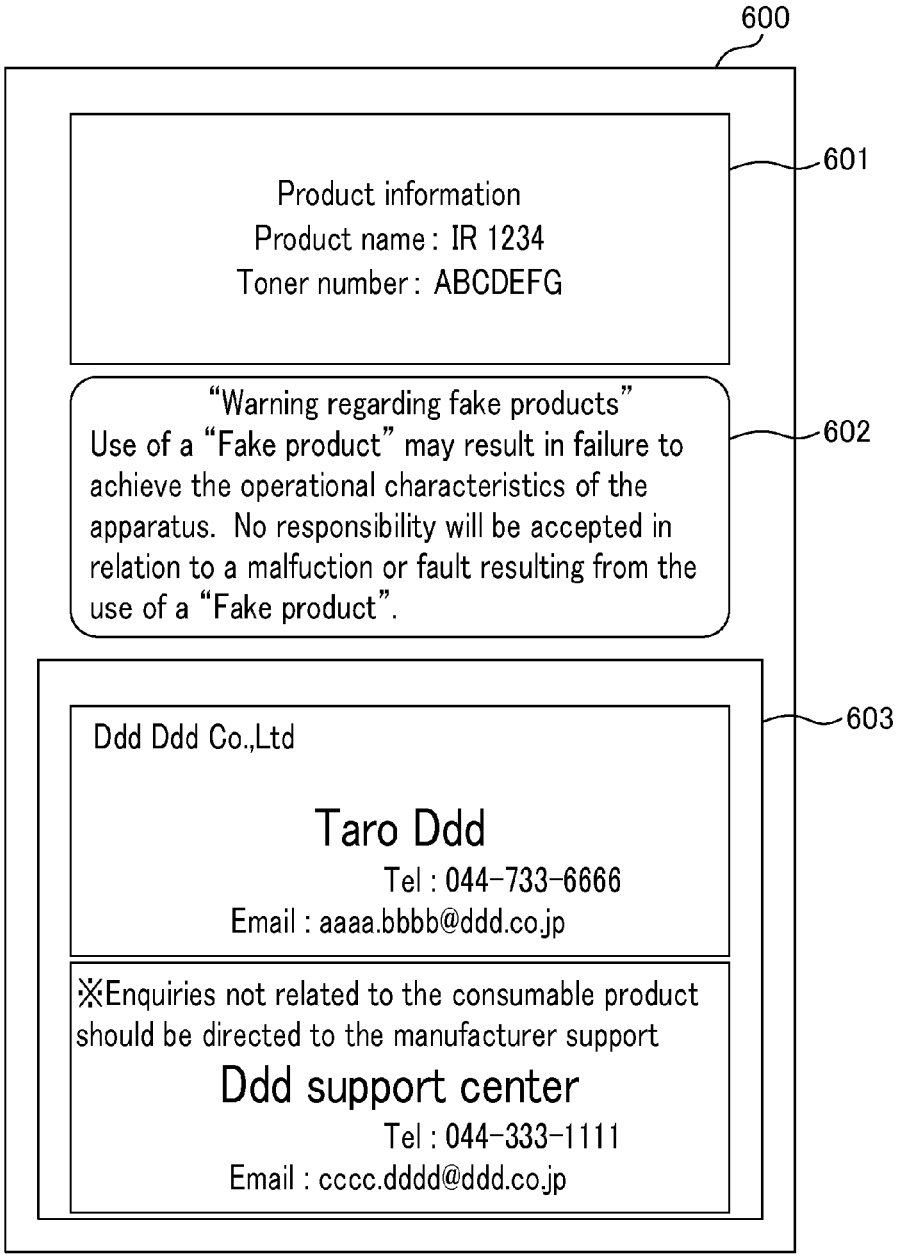
FIG. 6 illustrates a consumable product procurement information report.

The image management unit 230 expands the valid image region for print data input from the PC 102 or the PC 103 to the maximum size that is contained without omission in the consumable product procurement information report 600 illustrated in FIG. 6. The print data is input from the USB 2.0 device 140 for example. The print data may be input for example through the printer I/F 40 illustrated in FIG. 1 in addition to the USB 2.0 device 140. The function control unit 210 sends the received print data to the printing control unit 260 (for example, the LBP 45 illustrated in FIG. 1) without recording in the image management unit 230.

The event notification unit 250 uses the display control unit 220 to notify a user of the confirmation method for consumable product procurement information. The event notification unit 250 performs such a notification only when the exchange detection unit 251 detects the exchange period of a consumable product and the determination unit 252 determines that the image is recorded in the image management unit 230. That is to say, the exchange detection unit 251 functions as a detection unit configured to detect that supplementation of a consumable product is required. Furthermore, the determination unit 252 functions as a determination unit that determines whether or not an image corresponding to consumable product procurement information including information related to the procurement of a consumable product is recorded by linkage with the consumable product.

Figure 8:
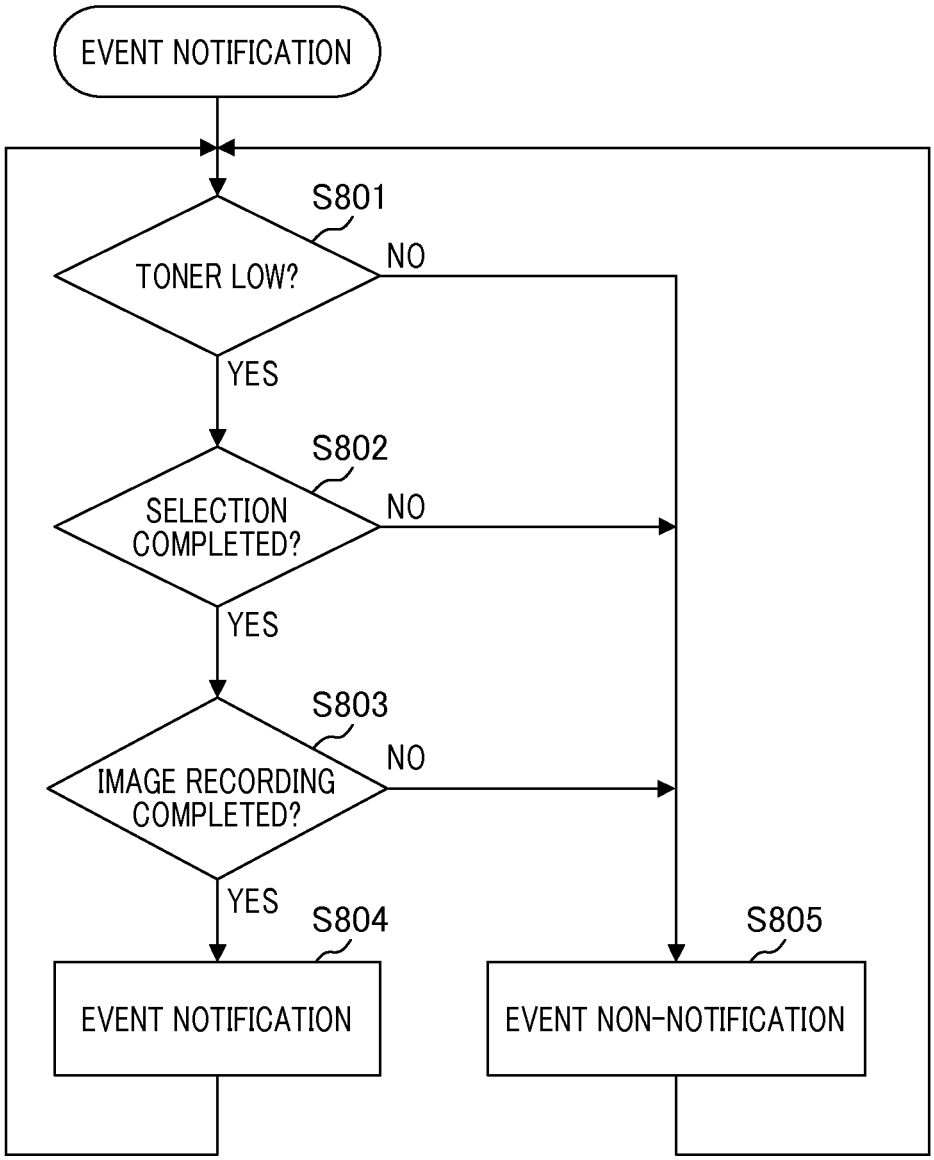
FIG. 8 is a flow diagram of a consumable product procurement information event notification.

If long pressing of a key (for example a reset key) of the operation unit 150 that is used for another purpose such as resetting and the like is detected during event notification by the event notification unit 250, the consumable product procurement information screen 400 illustrated in FIG. 4A is displayed through the display control unit 220. FIG. 5A to FIG. 5C illustrate the UI flow of the consumable product procurement information operation, and FIG. 8 is a processing flow diagram of the consumable product procurement information operation. The respective flow steps will be described below. While the event notification unit 250 is notifying the event, if long pressing by a user of a key of the operation unit 150 that is used for another purpose is detected, the operation of pressing the printer out 403 of the consumable product procurement information screen may be performed.

The exchange detection unit 251 determines whether or not the consumable product has reached an exchange period, and notifies the event notification unit 250 of whether or not the consumable product has reached an exchange period. For example, when the toner is in a low toner state, notification is performed that an exchange period has been reached, and in states other than a low toner state, notification is performed that an exchange period has not been reached. The exchange detection unit 251 may notify the event notification unit 250 only when the consumable product has reached an exchange period.

The determination unit 252 notifies the event notification unit 250 of whether or not the image management unit 230 records an image. The event notification unit 250 requests event notification to the function control unit 210 when the exchange detection unit 251 determines that the consumable product has reached an exchange period and the determination unit 252 determines that there is a recorded image. The function control unit 210 acquires the recorded image corresponding to the consumable product that is the object of event notification, and the event notification settings from the image management unit 230. The function control unit 210 transfers the received recorded image and the event notification settings to the printing control unit 260. The printing control unit 260 transfers the event notification settings and the recorded image to the image generation unit 261 and outputs an instruction for preparation of the report image.

The image generation unit 261 acquires the consumable product information that is retained in advance by the holding unit 262 based on the event notification settings and the recorded image data recorded by the image management unit 230. The image generation unit 261 produces report image data using the recorded image data and the acquired consumable product information. The image generation unit 261 transfers the generated report image data to the printing control unit 260. The printing control unit 260 outputs acquired report image data as a print product. More specifically, the print product is outputted by sending report image data to the LCD 135 through the LCDC 130. An example of a printing unit report image will be described below making reference to FIG. 6. There is no limitation in relation to the consumable product information that is retained in advance by the holding unit 262, and for example, may include a product name, a toner number or the text of a warning message. Various information may be retained depending on the model or the specification of the apparatus.

Figure 3:
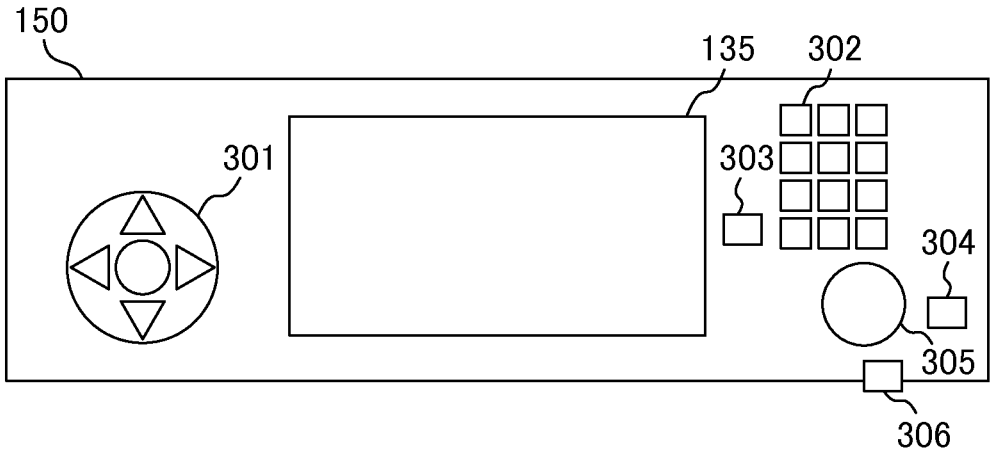
FIG. 3 describes an operation unit of the image forming apparatus.

FIG. 3 illustrates the operation unit 150 of the image forming apparatus 200. The operation unit 150 is configured from an LCD 135, a menu selection key 301, a numeric key pad 302, a reset key 303, a stop key 304, a start key 305 and a tally lamp 306.

The LCD 135 executes display based on various instructions from the LCDC 130. The menu selection key 301 is configured from keys for scrolling vertically or horizontally to select a menu displayed on the LCD 135 and keys for confirming the selected item. The numeric key pad 302 is a key for direct input of a value such as a copy number and the like. The reset key 303 is a key for clearing a state during setting, and to return the settings to an initial value. The start key 305 is a key for giving an instruction to commence various types of jobs. The stop key 304 is a key for giving instructions to stop a job that commences. The tally lamp 306 remains in an OFF state in the absence of an error and for example, is blinked when an error occurs in the image forming apparatus 200.

Figure 4:
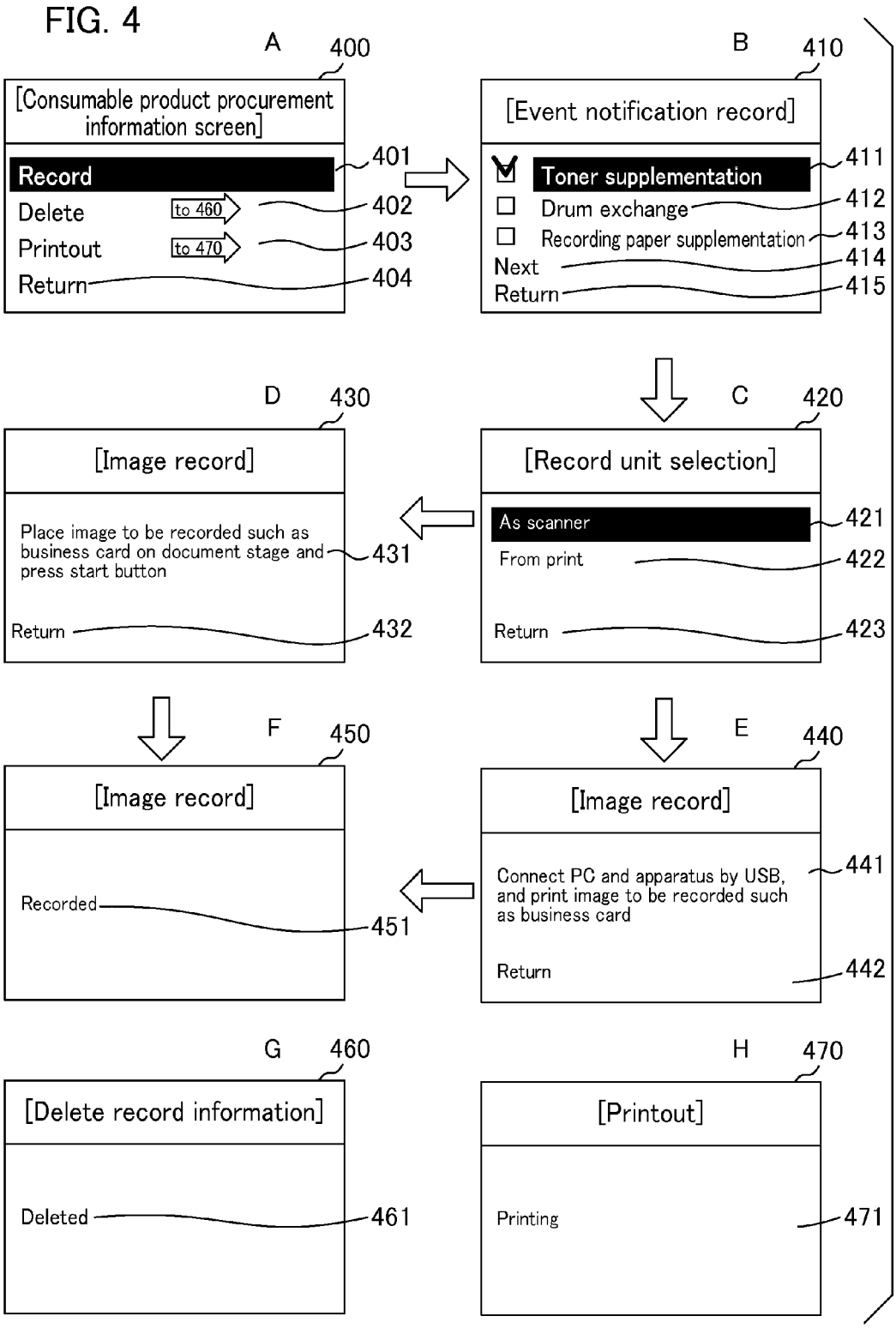
FIG. 4A to FIG. 4H are flow diagrams of the consumable product procurement information screen.
Figure 5:
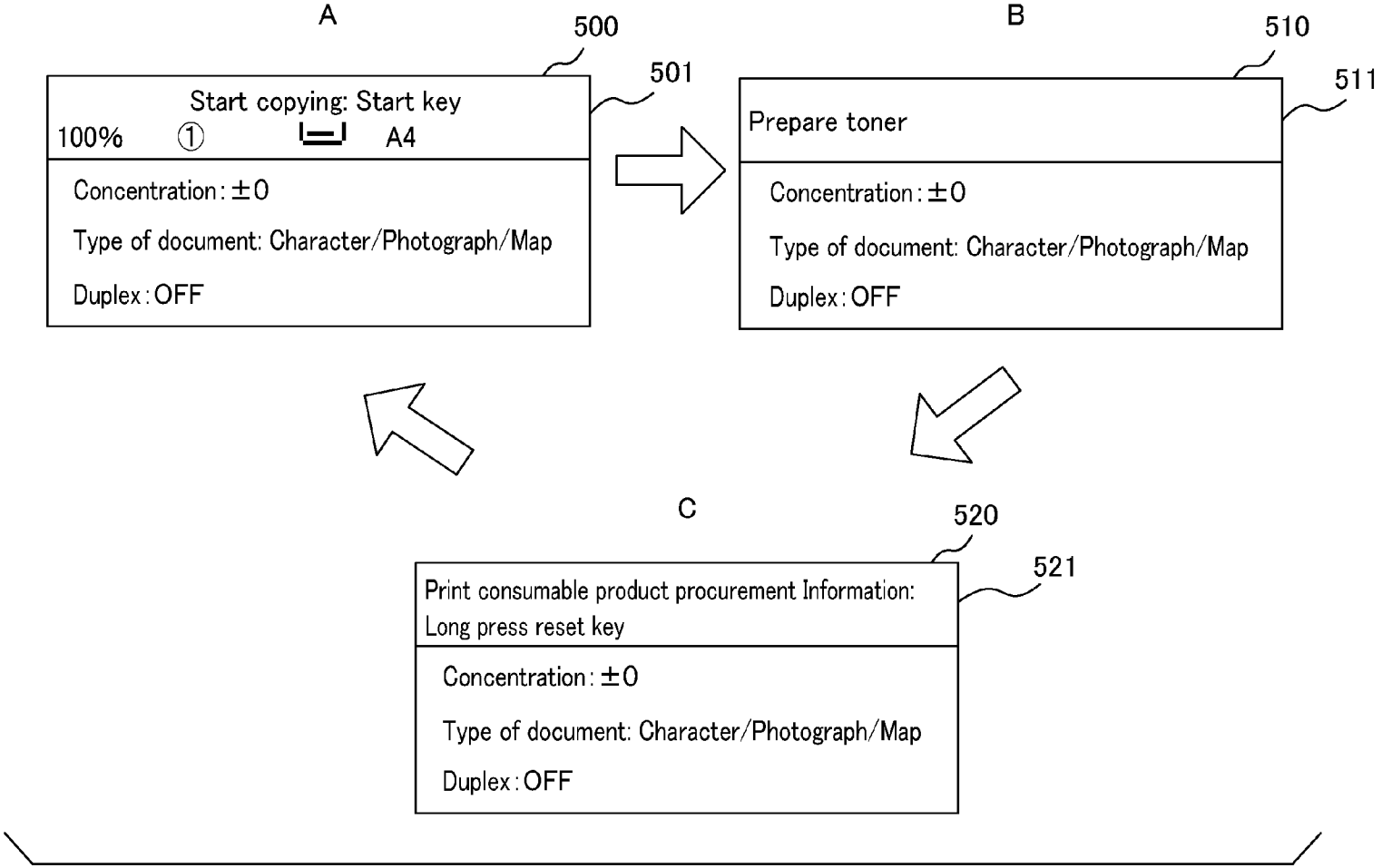
FIG. 5A to FIG. 5C illustrates a consumable product procurement information event notification screen.

FIG. 4 illustrates an example of a consumable product procurement information screen of the image forming apparatus 200. The various screens 400 (FIG. 4A) to 470 (FIG. 4H) are displayed on the LCD 135 of the operation portion 150 (for example an operation panel) of the image forming apparatus 200. The display control unit 220 that functions as a display unit receives an instruction from the function control unit 210 and displays the consumable product procurement information screen 400 to enable operations in relation to the consumable product procurement information on the image forming apparatus 200 by a user. On the consumable product procurement information screen 400, a user can select record 401, delete 402, printout 403 or return 404.

The display control unit 220 displays a screen for the event notification record 410 illustrated in FIG. 4B when it is detected that record 401 has been selected. The display control unit 220 displays the screen for record information deletion 460 illustrated in FIG. 4G when it is detected that delete 402 is selected. The display control unit 220 displays the screen for printout 470 illustrated in FIG. 4H when it is detected that printout 403 is selected.

Selection of various settings is enabled on the screen for the event notification record 410 for a user to set the consumable product that is the object of notification for use in event notification by the event notification unit 250 (event notification settings). On the screen for the event notification record 410, the display control unit 220 displays "toner supplementation 411" to notify at the toner exchange period, "drum exchange 412" to notify at the drum exchange period, and "recording paper supplementation 413" to perform event notification at recording paper supplementation period. On the screen for the event notification record 410, the display control unit 220 displays "return 415" to return to a previous screen and "next 414" to transition to a screen for the recording unit selection 420 illustrated in FIG. 4C. An example of an event notification will be described below making reference to FIG. 5A to FIG. 5C.

The display control unit 220 adds or deletes display of a check in relation to a check box displayed in the square on the left end when it is detected that one or a plurality of drum exchange 412 or recording paper supplementation 413 is selected by a user. The display control unit 220 displays the screen for the record unit selection 420 when selection of next 414 is detected.

The display control unit 220 displays "scan 421" for scanning and recording a business card and the like as a recording method for an image on the screen for record unit selection 420. Furthermore, the display control unit 220 displays "return 423" to return to a previous screen and "from print 422" to record received print data.

The display control unit 220 displays a screen for image record 430 illustrated in FIG. 4D when it is detected that scan 421 is selected by a user and displays the screen for image record 430 illustrated in FIG. 4E when it is detected that "from print 422" is selected. The display control unit 220 displays the description of a method of operation as illustrated in 431 and 441, and "return 432" or "return 442" to return to a previous screen as on the screen for image record 440 and image record 430.

The display control unit 220 detects that "scan 421" is selected by a user operation on the screen for record unit selection 420 and that the start button 305 has been pressed. The CPU 180 reads the image data with the scanner and transfers the read image data to the function control unit 210. The function control unit 210 instructs the image management unit 230 to store the received image data. Thereafter, the display control unit 220 displays the screen for the image record 450 illustrated in FIG. 4F for a fixed period and then displays the consumable product procurement information screen 400.

The display control unit 220 detects that "from print 422" is selected by a user operation on the screen for record unit selection 420 and that the start button 305 has been pressed. The function control unit 210 receives image data as print data from the printer I/F 40 by processing performed by the CPU 180. The function control unit 210 instructs the image management unit 230 to store the received image data. Thereafter, the display control unit 220 displays the screen for the image record 450 for a fixed period and then displays the consumable product procurement information screen 400.

When the deletion processing is completed for the event notification record related to the consumable product procurement information by the image management unit 230, the display control unit 220 displays a message for a fixed period in relation to deletion completion of the record information illustrated in 461 on the screen for the record information deletion 460 illustrated in FIG. 4G. The display control unit 220 displays the message for a fixed time and then displays the consumable product procurement information screen 400. The display control unit 220 displays the message during printing as illustrated at 471 on the screen for the printout 470 while the print control unit 260 is executing the print processing, and when printing is completed, displays the consumable product procurement information screen 400. As described above, a record for consumable product procurement information is enabled that is more accurate than a conventional record performed by writing since an image corresponding to the consumable product procurement information is read by use of a scanner or printer data.

FIG. 5A to FIG. 5C illustrate an example of an event notification by the image forming apparatus 200 (more specifically the screen 520 in FIG. 5C). The screen 500 illustrated in FIG. 5A is a screen that contains copying job start instructions displayed by the display control unit 220, and 501 is a copying setting partial display region for display of a part of the copy start settings. The screen 510 in FIG. 5A is a screen displayed by the display control unit 220 when the exchange detection unit 251 detects the toner exchange period. The display control unit 220 at this time switches the copying setting partial display region 501 to a message 511 and displays the message 511 in a fixed time.

When a notification request is received from the event notification unit 250, after the fixed period display of the message 511, the display control unit 220 displays the event notification. The display control unit 220 switches the message 511 to the message in 521 and displays for a fixed period. That is to say, when the display control unit 220 receives a display request for the toner exchange period from the exchange detection unit 251, and receives an event display request from the event notification unit 250, the messages illustrated by 500, 511 and 521 are switched and repeatedly displayed for a fixed period (termed "toggle display"). An event display in the present embodiment indicates a printing instruction screen for providing consumable product procurement information illustrated on the screen 521 in FIG. 5C. The display control unit 220 does not execute the display illustrated at 510, 520 when the exchange detection unit 251 does not detect the toner exchange period, and when the event notification unit 250 does not perform a notification request. The display control unit 220 only displays the message illustrated in 510 and does not display the event when the exchange detection unit 251 has detected the toner exchange period, but the event notification unit 250 does not perform a notification request due to the fact that the determination unit 252 determines that a record image is not available.

FIG. 6 illustrates an example of a consumable product procurement information report prepared by the image forming apparatus 200. Product information 601 is consumable product information retained in advance by the holding unit 262. The product name and toner number are retained as information that differs in accordance with the type or specification of the apparatus, and the method of display for display on the print product or the printed information may be different. For example, an apparatus specification is possible in which the toner number is not displayed. Therefore, the printing operation for the print product is performed in accordance with the preset setting information.

The reference numeral 602 denotes information that indicates warning information in relation to fake products and is retained in advance by the holding unit 262. That is to say, the holding unit 262 functions as a storage unit for storing product information in relation to the consumable product and warning information in relation to the consumable product. The warning information may be retained as warning information that differs in accordance with the type of consumable product. The reference numeral 603 denotes image data recorded by the image management unit 230 and, in this embodiment, indicates the business card of the sales party that sells the consumable product in the upper row. In the lower row, the contact details of the manufacturer are shown for user enquiries in relation to an enquiry for other than the consumable product. The following effects are enabled by including information that is related to an enquiry for other than a procurement order for the consumable product in the consumable product procurement information report. That is to say, the image data is used by the user to contact the sales party in relation to a consumable products such as toner and the like, and contact the manufacturer about an enquiry such as malfunction. Therefore, the user can correctly contact and communicate with the sales party or the manufacturer.

Figure 7:
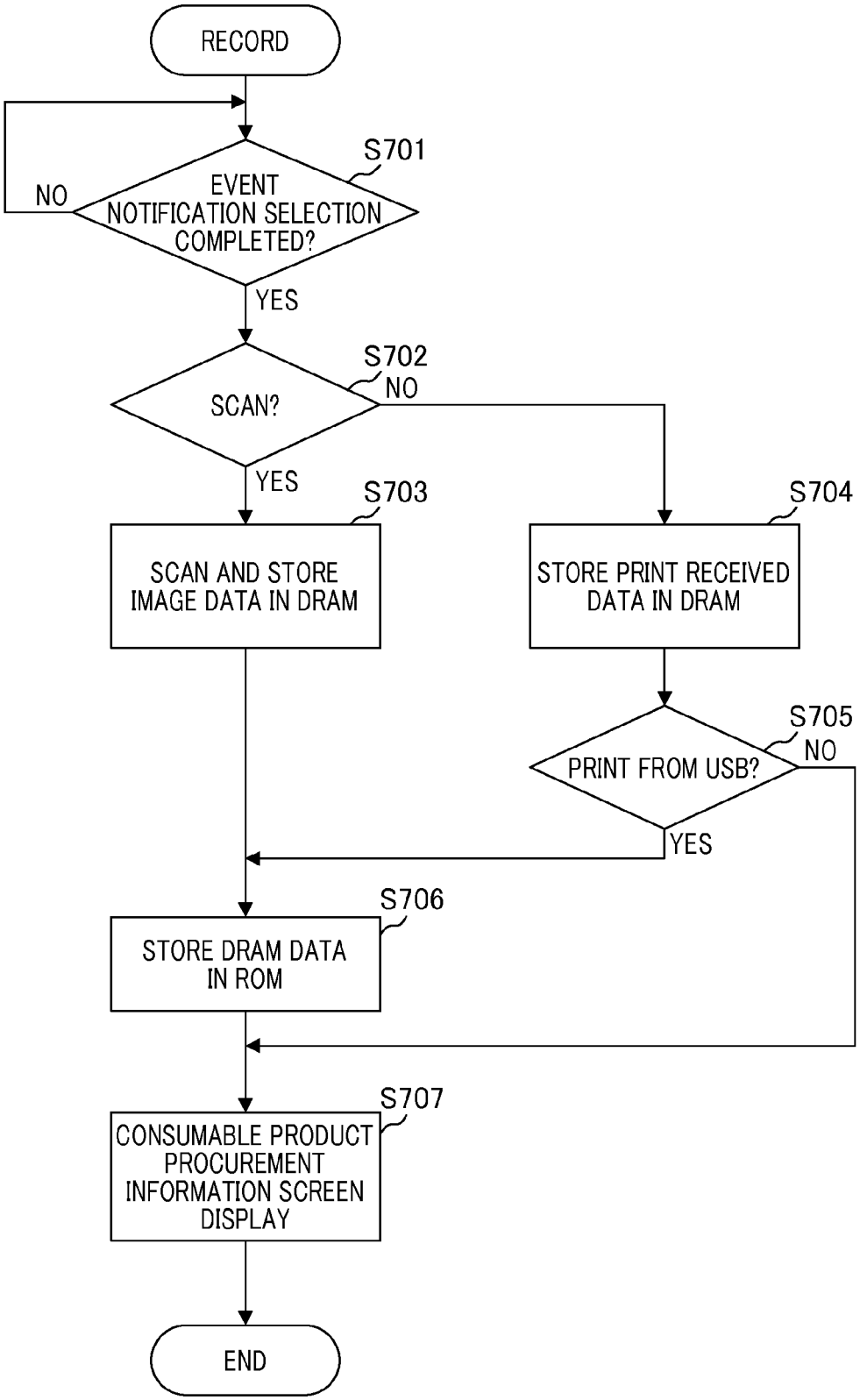
FIG. 7 is a flow diagram during consumable product procurement information recording.

FIG. 7 illustrates the recording process for consumable product information that is performed in accordance with an instruction from the function control unit 210 of the image forming apparatus 200 to the respective processing units. In a step S701, after selection of the event notification record by a user operation on the screen for the event notification record 410, and when the display control unit 220 detects that next 414 has been selected, the function control unit 210 performs the processing in S702. The display control unit 220 displays the consumable product procurement information screen 400 when selection of next 414 is not detected or when return 415 is detected. Alternatively, when selection of next 414 is not detected for at least a fixed period, a setting to finish the record processing of the consumable product procurement information may be applied.

In S702, the function control unit 210 determines whether or not the record method is a scanner when a selection by a user operation on the screen for record unit selection 420 is detected by the display control unit 220. The function control unit 210 performs the processing in S703 when "scan 421" is determined to be selected on the screen for record unit selection 420. The function control unit 210 performs the processing in S704 when selection of "from print 422" is detected. In S703, the image management unit 230 receives an instruction from the function control unit 210 and the CPU 180 executes the image processing of image data read by the scanner. More specifically, expanding processing is performed to the maximum size that is contained without omission in the consumable product procurement information report 600 and expanded image is stored. When the image processing is performed and the image data is stored, the processing proceeds to S707.

In S704, the image management unit 230 receives an instruction from the function control unit 210 and expanding processing is performed with respect to the print data input from the PC 102 or the PC 103 to the maximum size that is contained without omission in the consumable product procurement information report 600. In S705, the function control unit 210 determines whether or not the print data received in S704 is data from the USB 2.0 device 140. When the data is data from the USB 2.0 device 140, the function control unit 210 determines that it is processing object data for an event notification record, and stores the data in the image management unit 230. When the data is not data from the USB 2.0 device 140, the function control unit 210 for example determines that a process for printout is performed when print data is directly sent from the PC 102 for example, and storage processing to the image management unit 230 is not performed. For example, when a plurality of persons uses the image forming apparatus 200, it may be the case where print data for printout is sent during the event notification record to the function control unit 210. The function control unit 210 determines whether to store in the image management unit or perform printout with reference to whether or not the received print data is print data from the USB device 140.

In S706, the image management unit 230 links and stores the selection result in S701 with the image data acquired in S703 or S704. In S707, the function control unit 210 instructs the display control unit 220 to display the consumable product procurement information screen 400 and completes the processing. The processing described above enables a simple and accurate record of consumable product procurement information without the user themselves writing the consumable product procurement information. As a result, user operation features are enhanced.

FIG. 8 illustrates the processing of an event notification by the image forming apparatus 200. In S801, the exchange detection unit 251 detects whether or not there is a toner low state that is the toner exchange period, and notifies the event notification unit 250 of whether or not the consumable product is in an exchange period. When there is a toner low state, the processing in S802 is performed by the event notification unit 250. When there is not a toner lower state, the event notification unit 250 performs the processing in S805.

In S802, the event notification unit 250 acquires the event notification settings set by a user on the screen for 410 illustrated in FIG. 4B from the image management unit 230 through the function control unit 210, and refers to the details thereof. When there is a toner low, that is to say, when toner supplementation as illustrated at 411 in FIG. 4B is included in the notification settings, the processing in S803 is performed by the event notification unit 250. When a toner low is not included in the notification settings, the event notification unit 250 performs the processing in S805. In S803, the event notification unit 250 causes the determination unit 252 to determine whether or not there is a record image in the ROM 95. When the determination unit 252 determines that there is a record image in the image management unit 230, notification is performed to the event notification unit 250. When the image management unit 230 stores the record image, the event notification unit 250 performs the processing in S804.

The event notification unit 250 performs the processing in S805 when the image management unit 230 does not store the record image.

In S804, the display control unit 220 receives a notification request for an event from the event notification unit 250 through the function control unit 210, executes the display of the event notification 520 described in FIG. 5B and performs the processing in S801. In S805, the display control unit 220 does not display the event notification 520 and performs the processing in S801. That is to say, the display control unit 220 displays the printing instruction screen for the image when the determination unit 252 determines that the image corresponding to the consumable product procurement information is recorded and linked to a consumable product that is detected as requiring supplementation. This printing instruction screen corresponds to 521 in FIG. 5C. Printing is executed by a user long pressing of a reset key in accordance with a message displayed at 521. The above processing enables a user to prevent an unintended order. Furthermore, an event notification is performed only in relation to consumable product information selected by a user and therefore consumable product procurement information can be obtained when required by a user and enables a reduction in communication costs.

Figure 9:
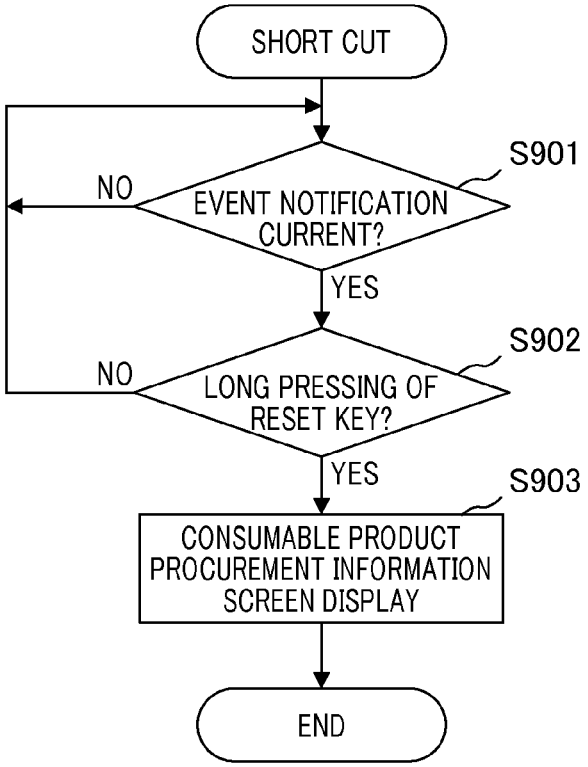
FIG. 9 is a flow diagram of a short cut in relation to the transition to the consumable product procurement information screen.

FIG. 9 is a flow diagram of a short cut in relation to the transition to the consumable product procurement information screen 400 in the display control unit 220 of the image forming apparatus 200. In S901, the function control unit 210 determines whether or not the display control unit 220 has notified an event upon receipt of a notification request from the event notification unit 250. The function control unit 210 performs the processing in S902 during the event notification, and performs the processing in S901 when not during the event notification.

In S902, the function control unit 210 determines whether or not a user has performed a long pressing of at least a fixed period, for example of at least 5 seconds, in relation to the reset key 303 of the operation unit 150. When the function control unit 210 determines a long pressing of at least 5 seconds, the processing in S903 is performed, and when a long pressing is not determined, the processing in S901 is performed. In S903, the function control unit 210 causes the display control unit 220 to display the consumable product procurement information screen 400, and finishes the processing. In S903, an operation during depression of the printout 470 on the consumable product procurement information screen 400 as described in FIG. 10 may be performed.

Figure 10:
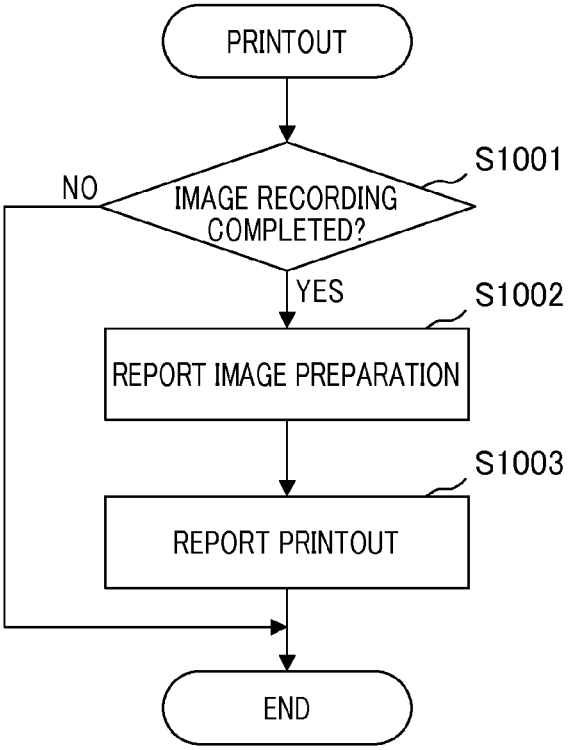
FIG. 10 is a flow diagram of a printout of consumable product procurement information.

FIG. 10 illustrates the processing of a printout 470 of the consumable product procurement information screen 400 executed by the printing control unit 260 upon instruction by the function control unit 210 that is an embodiment of the present invention. In S1001, the determination unit 252 refers to the image management unit 230 and determines whether or not a record image is available. When a record image is available, the processing proceeds to S1002, and when a record image is not available, the processing is finished.

In S1002, the function control unit 210 executes a printing instruction to the printing control unit 260 when it is determined that a long pressing of at least 5 seconds has been performed by a user operation on the reset key as described making reference to FIG. 9. The printing control unit 260 receives the printing instruction and instructs the image generation unit 261 to generate report image data. The report image data is data to be output by the printing control unit 260 as a consumable product procurement information report as illustrated in FIG. 6 for example. The image generation unit 261 acquires image data corresponding to the consumable product that is the object of generation included in the generation instruction for report image data (for example 603 in FIG. 6) from the image management unit 230. Furthermore, the image generation unit 261 acquires, from the holding unit 262, product information for the consumable product that is the object of generation (for example, 601 in FIG. 6) and warning information in relation to fake products (for example, 602 in FIG. 6). The image generation unit 261 generates report image data illustrated in FIG. 6 using the acquired image data, the product information for the consumable product and warning information for a fake product. The image generation unit 261 may only generate image data depending on the type or specification of the image forming apparatus 200. In S1003, the printing control unit 260 that has received report image data generated by the image generation unit 261 outputs the report image data as a print product. That is to say, the printing control unit 260 has the function of a printing unit that executes printing of an image in response to a printing instruction through a printing instruction screen. As described above, the image management unit 230 expands and stores the image data, and therefore a print product with a high level of visibility by the user is outputted. After output of the print product, the processing is ended.

According to the image forming apparatus of the present invention, when supplementation of a consumable product is required, the load on the user or the order destination of the consumable product is reduced since ordering and contacting are ensured in accordance with the intention of a user. Furthermore, since the procurement destination of a consumable product which a user desires can be confirmed, communication costs are reduced since printing of consumable product procurement information which a user does not desire is avoided.

In the above embodiment, the display control unit 220 displays an event notification when the exchange detection unit 251 detects the exchange period for a consumable product, and the determination unit 252 determines that image data linked to the consumable product is stored in the image management unit 230. Then consumable product information is outputted when detailed information for the consumable product or the contact details for the consumable product is required by a user. However, it is assumed that consumable product information cannot be outputted from the image forming apparatus 200 in case such as when the toner is completely out or when there is no paper remaining.

In a modified example of the above embodiment, the following processing may be performed in substitution for the processing in S1003 in FIG. 10. In the modified example, after generation of the report image by the image generation unit 261 upon receipt of an instruction from the printing control unit 260 in S1002, the printing control unit 260 does not output a report image. In substitution, the image management unit 230 receives an instruction from the function control unit 210 and executes compression processing so that the record image is modified to meet the maximum size that can be contained in the screen displayed by the display control unit 220. The function control unit 210 instructs the display control unit 220 to display the compressed record image on the screen. The above processing enables the accurate acquisition of the contact details by a user since an image that is read by a scanner and the like is displayed as consumable product information on the screen of the image forming apparatus 200 even when output of the consumable product information is not possible. Furthermore, cost reductions are also realized since unnecessary use of paper is avoided. In the modified example described above, although an image was displayed on the screen by the display control unit 220, when using a large display screen with excellent visibility, the overall report image illustrated in FIG. 6 may be displayed. Naturally, the displayed details are not limited to image data, and text data may be displayed when consumable product information from a PC 102 or PC 103 is recorded using text data.

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-034239 filed Feb. 20, 2012, which is hereby incorporated by reference herein in its entirety.

What is claimed is:

1. An image forming apparatus comprising:

a storage unit configured to store product information for a consumable product and message information related to the consumable product, the message information including information regarding a non-compliant consumable product;

a recording unit configured to record an image which shows consumable product procurement information for a source that provides the consumable product, wherein the image that is recorded by the recording unit is read by use of a scanner, or read from an external storage apparatus that is connected to the image forming apparatus;

a detection unit configured to detect that replenishment of the consumable product is required;

a determination unit configured to determine whether or not the image which shows the consumable product procurement information including information related to procurement of the consumable product is recorded by the recording unit in relation to the consumable product detected by the detection unit;

a display unit configured to display a printing instruction screen informing a user to print the image which shows the consumable product procurement information when the detection unit detects that replenishment of the consumable product is required and the determination unit determines that the image is recorded in relation to the consumable product detected by the detection unit; and a printing unit configured to print the image which shows the consumable product procurement information in response to a printing instruction issued through the printing instruction screen, wherein the printing unit prints the image, the stored product information for the consumable product and the stored message information as a consumable product report.

2. The image forming apparatus according to claim 1, wherein the consumable product procurement information further includes information related to an inquiry other than an order for procurement of the consumable product.

3. The image forming apparatus according to claim 1, wherein the recording unit records the image when initial settings are performed for the image forming apparatus.

4. The image forming apparatus according to claim 1, further comprising an image processing unit configured to execute image processing to expand a size of the image when printing of the image recorded by the recording unit is performed by the printing unit.

5. The image forming apparatus according to claim 1, wherein, when the detection unit detects that replenishment of the consumable product is required, if the determination unit determines that the image which shows the consumable product procurement information is not recorded in relation to the consumable product, the display unit does not display the printing instruction screen for printing the image.

6. A control method executed in an image forming apparatus, the control method comprising:

storing, in a storage unit, product information for a consumable product and message information related to the consumable product, the message information including information regarding a non-compliant consumable product;

recording, in a recording unit, an image which shows consumable product procurement information for a source that provides the consumable product, wherein the image that is recorded in the recording unit is read by use of a scanner, or read from an external storage apparatus that is connected to the image forming apparatus;

detecting that replenishment of the consumable product is required;

determining whether or not the image which shows the consumable product procurement information that includes information related to procurement of the consumable product is recorded by the recording unit in relation to the consumable product detected in the detecting step;

displaying a printing instruction screen informing a user to print the image which shows the consumable product procurement information when it is detected in the detecting step that replenishment of the consumable product is required, and it is determined in the determining step that the image which shows the consumable product procurement information is recorded in relation to the consumable product detected in the detecting step; and printing the image which shows the consumable product procurement information in response to a printing instruction issued through the printing instruction screen, wherein, in the printing, the image, the stored product information for the consumable product and the stored message information is printed as a consumable product report.

7. A non-transitory storage medium on which is stored a computer program for making a computer execute a control method in an image forming apparatus, the control method comprising:

storing, in a storage unit, product information for a consumable product and message information related to the consumable product, the message information including information regarding a non-compliant product;

recording, in a recording unit, an image which shows consumable product procurement information for a source that provides the consumable product, wherein the image that is recorded in the recording unit is read by use of a scanner, or read from an external storage apparatus that is connected to the image forming apparatus;

detecting that replenishment of the consumable product is required;

determining whether or not the image which shows the consumable product procurement information that includes information related to procurement of the consumable product is recorded by the recording unit in relation to the consumable product detected in the detecting step;

displaying a printing instruction screen informing a user to print the image which shows the consumable product procurement information when it is detected in the detecting step that replenishment of the consumable product is required, and it is determined in the determining step that the image which shows the consumable product procurement information is recorded in relation to the consumable product detected in the detecting step; and printing the image which shows the consumable product procurement information in response to a printing instruction issued through the printing instruction screen, wherein, in the printing, the image, the stored product information for the consumable product and the stored message information is printed as a consumable product report.

* * * * *